United States Patent [19]

Sakurada et al.

[11] Patent Number: 4,589,268

[45] Date of Patent: May 20, 1986

[54] METHOD OF CONTROLLING MILL PACING

[75] Inventors: Kazuyuki Sakurada; Takanori Fujiwara; Yutaka Funyu, all of Handa, Japan

[73] Assignee: Kawasaki Steel Corporation, Hyogo, Japan

[21] Appl. No.: 603,632

[22] Filed: Apr. 25, 1984

[51] Int. Cl.[4] ..... B21B 37/00

[52] U.S. Cl. ..... 72/8; 72/13; 72/202

[58] Field of Search ..... 72/8, 9, 11, 12, 13, 72/31, 200, 202

[56] References Cited

U.S. PATENT DOCUMENTS

| | | | |
|---|---|---|---|
| 2,209,968 | 8/1940 | Gould et al. | 72/202 X |
| 4,373,364 | 2/1983 | Tanimoto et al. | 72/200 X |

FOREIGN PATENT DOCUMENTS

| | | | |
|---|---|---|---|
| 545402 | 3/1977 | U.S.S.R. | 72/202 |
| 584917 | 12/1977 | U.S.S.R. | 72/202 |
| 599869 | 3/1978 | U.S.S.R. | 72/202 |
| 609564 | 6/1978 | U.S.S.R. | 72/202 |
| 612267 | 6/1978 | U.S.S.R. | 72/202 |
| 647024 | 2/1979 | U.S.S.R. | 72/200 |

*Primary Examiner*—E. Michael Combs
*Attorney, Agent, or Firm*—Koda and Androlia

[57] ABSTRACT

According to the present invention, in a method of controlling a mill pacing in a rolling equipment wherein a plurality of serial rolling mills are provided downstream of a heating furnace in which a plurality of materials are rested on a furnace hearth integrally moving with the materials and can be successively extracted, respective rolling cycle times are sought from periods of time between the starts of rolling in respective rolling mills of a subsequent material to be extracted from the heating furnace and the readiness for rolling of the following material in the respective rolling mills, the maximum value of the above-described respective rolling cycle times is assumed as an extraction cycle time of the subsequent material to be extracted to thereby presuppose an extraction time of the subsequent material to be extracted from the heating furnace, allowable retard periods of time of the materials immediately before the respective rolling mills are predetermined, the presupposed retard periods of time of the subsequent materials to be extracted immediately before the respective rolling mills are confirmed to be within the aforesaid allowable retard periods of time, and further, a heating critical cycle time is confirmed to be securable which is sufficient for applying heat of a predetermined value to the subsequent material to be extracted through the latest material to be loaded, whereby the subsequent material is extracted at the aforesaid presupposed extraction time. As a result, the operating condition of the rolling line as a whole are optimized, so that the productivity can be improved.

1 Claim, 4 Drawing Figures

METHOD OF CONTROLLING MILL PACING

BACKGROUND OF THE INVENTION

1. Field of the Invention

This invention relates to a method of controlling mill pacing wherein an extraction pitch of a heating furnace is determined while the progress of rolling is controlled in a rolling equipment wherein a plurality of serial rolling mills are provided downstream of the heating furnace in which a plurality of materials are rested on a furnace hearth integrally moving the materials and which can be successively extracted.

2. Description of the Prior Art

In a rolling equipment for seamless steel pipes, shapes and the like, a multiplicity of materials to be rolled are present in a rolling line consisting of a heating furnace and a plurality of rolling mills. Particularly, as compared with the plate rolling, in the seamless steel pipe rolling, the number of rolling mills under control is numerous and the number of pipes under control is numerous, whereby it has been very difficult to shorten a cycle time. In the aforesaid rolling equipment of the prior art, there exists the techniques of controlling the respective rolling mills and the heating furnace; in each the operation thereof has relied on the experiences and the skill of the operators, whereby it has been impossible to improve the productivity to an ideal extremity.

In addition, as a technique for reference, there is a method of controlling a heating furnace described in Patent Kokai (Laid-Open) No. 127812/79 issued by the Patent Office of Japan. However, this method of controlling contemplates that the relations between the elapsed time and the temperature of piercing are sought for the heating furnace and a piercer to thereby control the furnace temperature of the heating furnace, and; as a result a disadvantage is created that the conditions of the group of mills in a posterior process following that of the piercer cannot be sensed.

The present invention has as its object the provision of a method of controlling a mill pacing in a rolling equipment wherein the operating conditions of a rolling line as a whole is optimized to improve the productivity.

SUMMARY OF THE INVENTION

To achieve the above-described object, the present invention contemplates that, in a method of controlling mill pacing in a rolling equipment wherein a plurality of serial rolling mills are provided downstream of a heating furnace in which a plurality of materials are rested on a furnace hearth integrally moving with the materials and can be successively extracted, respective rolling cycle times are sought from periods of time between the start of rolling in respective rolling mills of a subsequent material to be extracted from the heating furnace and the readiness for rolling of the following material in the respective rolling mills, the maximum value of the above-described respective rolling cycle times is assumed as an extraction cycle time of the subsequent material to be extracted to thereby presuppose an extraction time of the subsequent material to be extracted from the heating furnace, allowable retard periods of time of the materials immediately before the respective rolling mills are predetermined, the presupposed retard periods of time of the subsequent materials to be extracted immediately before the respective rolling mills are confirmed as being within the aforesaid allowable retard periods of time, and further, a heating critical cycle time is confirmed to be securable which is sufficient for applying heat of a predetermined value to the subsequent material to be extracted through the latest material to be loaded, whereby the subsequent material is extracted at the aforesaid presupposed extraction time.

DESCRIPTION OF A PREFERRED EMBODIMENT OF THE INVENTION

Description will hereunder be given of an embodiment of the present invention with reference to the drawings.

Figure 1:
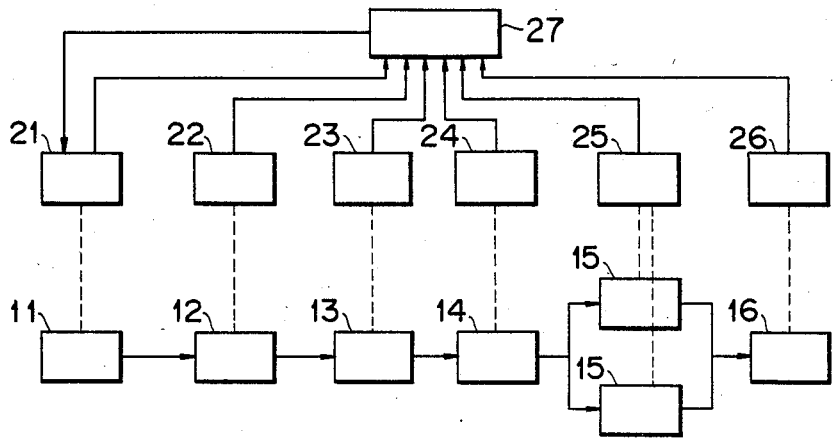
FIG. 1 is a diagram of control system showing an embodiment, in which the present invention is applied to a rolling equipment for seamless steel pipes.

FIG. 1 is a diagram of control system, showing an embodiment, in which the present invention is applied to a roling equipment for seamless steel pipes. More specifically, this rolling equipment is a rolling line for seamless steel pipes according to the Mannessmann-plug mill system, wherein the material, which has been heated in a heating furnace 11, is pierced and rolled in a piercer 12, rolled for pipe-expanding and elongating the material in an elongater 13, rolled to a length of a pipe having a wall thickness substantially equivalent to the product wall thickness in a plug mill 14, the inner and outer surfaces of the pipe-shaped material are polished by two reelers 15 and the wall thickness reduction and pipe-expanding to a certain extent are effected, and the material is finished to be a pipe having an outer diameter of a predetermined value in a sizer 16, thus providing a final product. In addition, the heating furnace 11 is of a rotary furnace hearth type, in which a plurality of materials are rested on the furnace hearth integrally moving the materials, and can be successively extracted.

In the above rolling equipment, the heating furnace 11 is controlled by a heating furnace control device 21 and the mills 12 through 16 are controlled by respective rolling mill control devices 22 through 26. An actual result of extraction of the material obtained in the heating furnace control device 21 and actual results of rolling of the materials obtained in the respective rolling mill control devices 22 through 26 are transmitted to a calculating means 27. As will be described below, the calculating means 27 determines the optimal extraction time in the heating furnace 11 and makes it possible to transmit the extraction time to the heating furnace control device 21.

Figure 2:
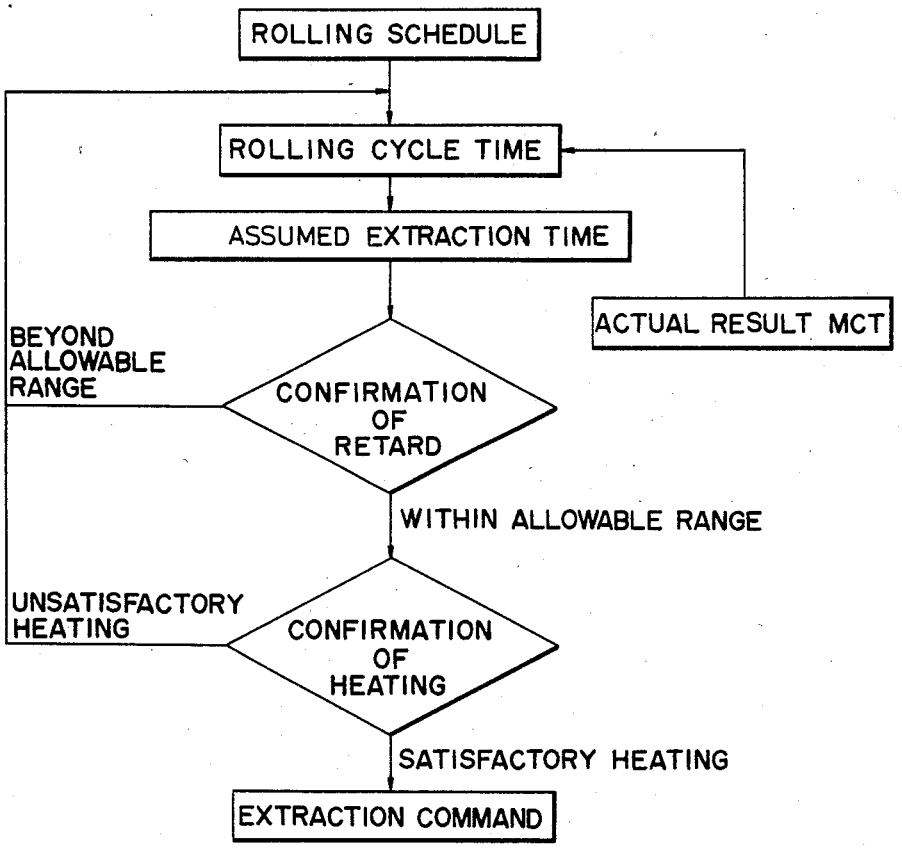
FIG. 2 is a flow chart showing control steps of a calculating means in the above embodiment.
Figure 3:
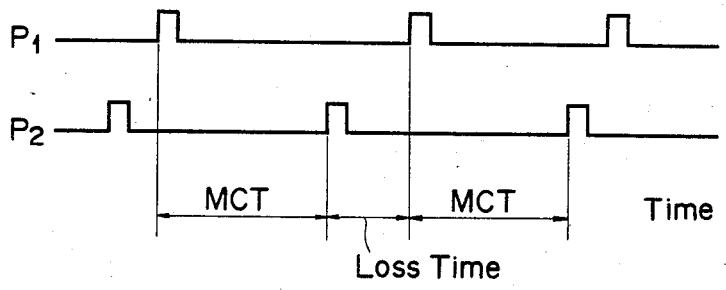
FIG. 3 is an explanatory view showing the definition of a rolling cycle time in the above embodiment.

The operation of the calculating means 27 is shown in FIG. 2. More specifically, the calculating means 27 calculates and presupposes respective rolling cycle times MCT between the starts of rolling in the respective rolling mills 12 through 16 of a subsequent material to be extracted from the heating furnace 11 and the completion of the preparation for rolling of the following material on the basis of a rolling schedule. Here, the rolling cycle time MCT is defined as a period of time between the time of starting the rolling and time of completing the preparation for the rolling as indicated by a rolling starting signal $P_1$ and a following material rolling readiness signal $P_2$ in FIG. 3. Then, after pierced materials of the same lot in material quality, dimensions and the like as the subsequent material to be extracted have been passed through the mills 12 through 16, respective presupposed cycle times MCT are calculated on the basis of actual resulting cycle times MCT collected in the respective rolling mill control devices 22 through 26. Whereas, before pierced materials of the same lot as the subsequent materials have not yet been passed through the mills 12 through 16, the respective presupposed rolling cycle times MCT are calculated on the basis of rolling speeds, rolling lengths, required idle times and the like in the respective mills 12 through 16. More specifically, the aforesaid rolling cycle time MCT is the truly required rolling cycle time in the rolling mill under the control. The period of time between the completion of preparation for the following material and the start of rolling is a loss time wherein the rolling mill under the control. Therefore, it is desirable that the loss times be eliminated in all of the rolling mills; however, the loss times in all of the rolling mills cannot be eliminated because the rolling cycle times MCT are different from one rolling mill to another. Then, if the loss time is eliminated in the rolling mill (equipment under critical condition) having the largest rolling cycle time MCT, then it becomes possible to improve the productivity to the utmost under given conditions. In other words, this means that the subsequent material should be extracted from the heating furnace 11 by the rolling cycle time of one of the mills 12 through 16, which has the largest rolling cycle time MCT. In consequence, the calculating means 27 adds the largest value of the rolling cycle times MCT relating to the aforesaid subsequent material to be extracted, i.e. an assumed extraction cycle time to the latest actual result extraction time of the heating furnace 11 transmitted from the heating furnace control device 21, to thereby assume an extraction time of the subsequent material to be extracted.

Here, if the assumed extraction cycle time determined from the respective rolling cycle times MCT as described above is too short, then the loss times in the respective mills 12 through 16 are decreased, however, there occur some cases where materials are retarded immediately before the mills 12 through 16, thus leading to deteriorated product quality and considerably worn rolling tools such as reduction rolls due to lowered temperature of the material. Therefore, the calculating means 27 previously determines allowable retard periods of time for the materials immediately before the mills 12 through 16, confirms that the presupposed retard periods of time of the subsequent materials to be extracted immediately before the mills 12 through 16 are within the range of the aforesaid allowable retard periods of time; and when the presupposed retard periods of time are beyond the range of the allowable retard periods of time, the calculating means 27 performs again the calculation and presupposition of respective rolling cycle times MCT and the provisional calculation of the extraction time.

More specifically, the aforesaid allowable retard periods of time will be determined in the following manner. To cite a seamless steel pipe for example, a theoretical radiation calculation formula (the relationship of the lowered value of the temperature of a pipe material with the elapsed time) on the dimensions (outer diameter and wall thickness) of the pipe materials in the respective mills 12 through 16 is sought, while, the relationships between the temperature of the pipe material and defects on the inner surface of the pipe material and between the temperature of the pipe material and wear of the rolling tools, etc. are sought on the basis of the actual results, and it is determined within what retard period of time at the largest the rolling can be started in order to roll the pipe material within the range of suitable temperature.

Furthermore, the calculation of the presupposed retard periods of time immediately before the mills 12 through 16 and the confirmation that the presupposed retard periods of time are within the range of the allowable retard period of time are carried out in the following manner. Namely, if a presupposed rolling cycle time MCT of a material No. i counted from the latest material (1) to be started for rolling in a rolling mill No. x is made to be MCTx(i), a target extraction time of the subsequent material (n) to be extracted from the heating furnace 11 is made to be Tn and an actual result time when the latest material to be started for rolling in the rolling mill No. x is extracted from the heating furnace 11 is made to be $T_1$, then a presupposed retard period of time $h_x$ of the subsequent material to be extracted immediately before the rolling mill No. x is sought through the following equation.

$$h_x = \sum_{i=1}^{n} MCTx(i) - (Tn - T1) \tag{1}$$

Subsequently, an allowable retard period of time in the rolling mill No. x is made to be $r_x$ and a difference $f_x$ between $r_x$ and the presupposed retard period of time $h_x$ is sought through the following equation.

$$f_x = \sum_{i=1}^{n} MCTx(i) - (Tn - T1) - r_x \tag{2}$$

Further, calculation is made through the following equation for the rolling mills from No. 1 to the final one (No. m). And, if $F \leqq 0$, then it is judged that extraction can be made, and, if $F > 0$, then it is judged that extraction cannot be made.

$$F = MAX(f_1 \ldots f_x \ldots f_m) \tag{3}$$

As described above, when the subsequent materials to be extracted are conveyed to the mills 12 through 16, the calculating means 27 calculates and presupposes the periods of time for awaiting the rolling immediately before the mills 12 through 16, i.e. retard periods of time. When the retard periods of time are within the range of allowable values for all of the rolling mills, it is judged that extraction can be made, and when the retard period of time exceeds the allowable retard period of time in any one of the rolling mills, it is judged that extraction cannot be made.

However, when the subsequent material is extracted from the heating furnace 11 as described above, if the extraction cycle time is short, then such a case occurs in the heating furnace 11 that the material is not satisfactorily and uniformly heated, thus causing undesirable influence to the product quality. Then, the calculating means 27 calculates a heating critical cycle time HCT sufficient for applying heat of a predetermined value to the respective materials including the subsequent material to be extracted and the latest material to be extracted, which are present in the heating furnace 11, on the basis of the rolling schedule. More specifically, the calculating means 27 calculates the heating critical cycle time sufficient for applying heat of the predetermined value to the respective materials being present in the heating furnace 11 through the following equation.

$$HCT=MAX(CT_1 \ldots CT_m \ldots CT_n) \quad (4)$$

The $CT_m$ above is sought through the equation (5) which will be shown below.

$$CT_m=f(D_m, L_m) \quad (5)$$

where $CT_m$ is a furnace neck extraction cycle time to a material of lot No. m in looking from the side of extraction, $D_m$ a diameter of the material of lot No. m, and $L_m$ a length of the material of lot No. m.

Further, when the subsequent material is extracted at the assumed extraction time, the calculating means 27 judges whether or not the aforesaid heating critical time HCT is secured between the subsequent material to be extracted and its preceding material to be extracted. When it is judged that the heating critical cycle time HCT can be secured, the calculating means 27 transmits the aforesaid assumed extraction time to the heating furnace control device 21 as the optimal extraction time for the subsequent material to be extracted. When it is judged that the aforesaid heating critical cycle time HCT is not secured, the calculating means 27 repeats the calculation and presupposition of the respective rolling cycle times MCT, assumption of the extraction time, confirmation that the presupposed retard period of time is within the allowable retard period of time and confirmation that the heating critical cycle time can be secured.

In addition, the rolling start signal necessary for determining the rolling cycle times MCT in the mills 12 through 16 and the subsequent material rolling readiness signal are determined as shown in Table 1.

Figure 4:
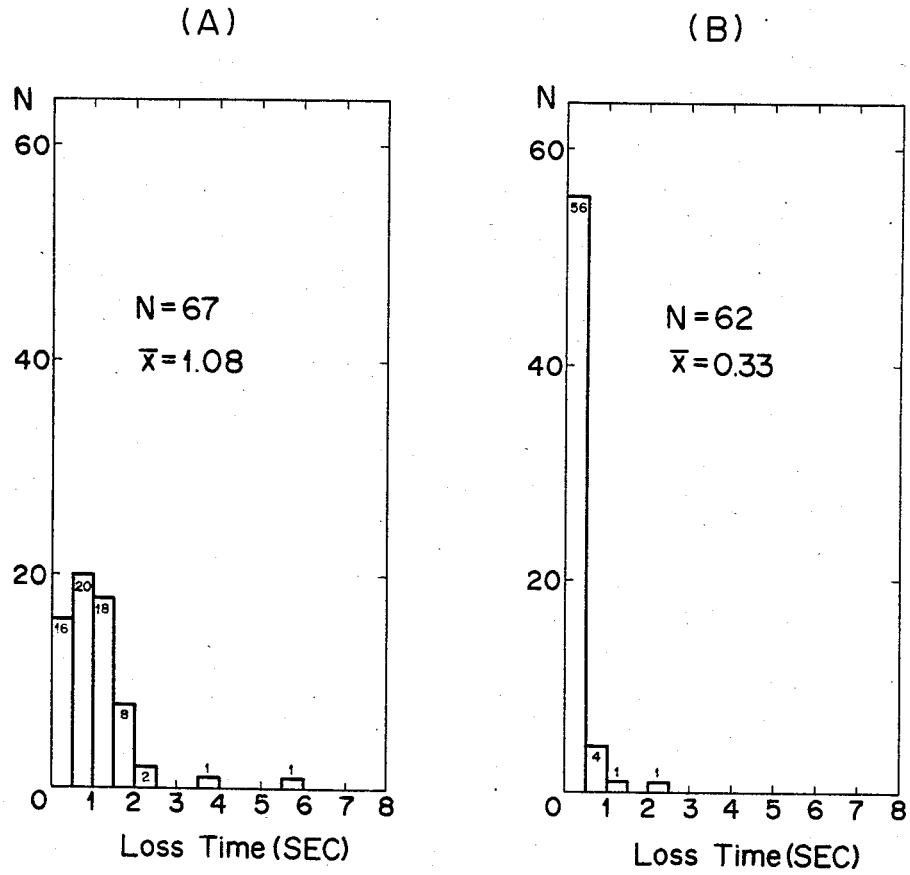
FIG. 4A is a histogram showing the relationship between the loss time and the number of materials in the equipment under critical condition of the conventional system.
FIG. 4B is a histogram showing the relationship between the loss time and the number of materials in the equipment under critical according to the present invention.

FIGS. 4A and 4B are histograms showing the relationship between the loss time and the number of materials N in the equipment under critical condition in the operating system according to the prior art and in the operating system according to the present invention, respectively, when the materials each having a diameter of 230 mm and a length of 1,535 mm are loaded into the heating furnace in two rows and rolled into steel pipes each having an outer diameter of 273.6 mm, a wall thickness of 6.35 mm and a length of 11,705 mm. As apparent from

TABLE 1

| Devices | Signals | Timing of generatin signals |
|---|---|---|
| Piercer 12 | Rolling start | When a pusher starts advancing |
| | Subsequent material rolling readiness | When the subsequent material is completed in set-up |
| Elongater 13 | Rolling start | When the pusher starts advancing |
| | Subsequent material rolling readiness | When the subsequent material is completed in set-up |
| Plug mill 14 | Rolling start | When one pass rolling pusher starts advancing |
| | Subsequent material rolling readiness | When the subsequent material is completed in set-up |
| Reelers 15 | Rolling start | When a table roller on input side of rolling mill starts normal rotation |
| | Subsequent material rolling readiness | When the subsequent material is completed in set-up |
| Sizer 16 | Rolling start | When the table roller on input side of rolling mill starts normal rotation |
| | Subsequent material rolling readiness | When the subsequent material is completed in set-up |

FIGS. 4A and 4B, an average loss time in the operating system according to the prior art is 1.08 sec., whereas an average loss time in the operating system according to the present invention is 0.33 sec., thus remarkably improving the productivity according to the present invention.

The present invention is applicable not only to the production line for seamless steel pipes in accordance with the Mannessmann-plug mill system but also to the rolling equipment for seamless steel pipes according to the Mandrel mill system, Assel mill system and the like. Further, the present invention is applicable to the rolling equipment for rolling bar steel, wire steel and the like. Furthermore, the present invention is applicable irrespective of the number of rolling mills, and on the contrary, the larger the number of rolling mills is, the greater the advantages attained.

What is claimed is:

1. A method of controlling a mill pacing in a rolling equipment wherein a plurality of rolling mills are provided downstream of a heating furnace in which a plurality of materials rest on a furnace hearth integrally moving with the materials for successively extracting said materials from said furnace, comprising the steps of:

(a) predetermining an allowable retard period of time $r_x$ for said materials;

(b) calculating a presupposed retard period of time $h_x$ from the following equation:

$$h_x = \sum_{c=1}^{h} MCTx(i) - (T_n - T_1)$$

wherein MCTx(i) is a presupposed rolling cycle time (MCT) of a material i counted from the latest material to be started for rolling in a rolling mill x, $T_n$ is a target extraction time of a subsequent material n to be extracted from the heating furnace and $T_1$ is an actual time the latest material to be started for rolling in the rolling mill x is extracted from the heating furnace;

(c) calculating a difference $f_x$ between the predetermined allowable retard period of time $r_x$ and the presupposed retard period of time $h_x$ from the following equation:

$$h_x = \sum_{c=1}^{h} MCTx(i) - (T_n - T_1) - r_x$$

(d) determining the maximum difference F for each of the rolling mills x from 1 to m from the following equation:

$$F=MAX(f_1 \ldots f_x \ldots f_m)$$

(e) confirming that the allowable retard period of time $r_x$ is acceptable if $F \leqq 0$ and not acceptable if $F > 0$;

(f) continuing with step (g), if $r_x$ is acceptable or predetermining another allowable retard period of time $r_x$ and repeating the steps (a) through (f) if $r_x$ is not acceptable;

(g) calculating a furnace neck extraction cycle time $CT_m$ for said particular material m from 1 to n as a function of the type of material m, a diameter $D_m$ of the material m and a length $L_m$ of the material m from the following equation:

$$CT_m = f(D_m, L_m)$$

(h) determining a heating critical cycle time HCT sufficient for applying heat of a predetermined value to the material 1 to n including the subsequent material to be extracted and the latest material to be extracted from the heating furnace from the following equation:

$$HCT = MAX(CT_1 \ldots CT_m \ldots CT_n)$$

(i) determining if the heating critical cycle time HCT is the time interval between the extraction of the subsequent material and a preceding material; and (j) extracting the material at the heating critical cycle time HCT if the heating critical cycle time is the time interval between the extraction of the subsequent material and a preceding material or predetermining another allowable retard period of time $r_x$ and repeating steps (a) through (j) if the heating critical time HCT is not said time interval.

* * * * *